US010047429B2

(12) United States Patent
Ohki

(10) Patent No.: US 10,047,429 B2
(45) Date of Patent: Aug. 14, 2018

(54) GAS NITROCARBURIZING METHOD AND METHOD FOR MANUFACTURING BEARING PART

(75) Inventor: Chikara Ohki, Kuwana (JP)

(73) Assignee: NTN CORPORATION, Osaka (JP)

( * ) Notice: Subject to any disclaimer, the term of this patent is extended or adjusted under 35 U.S.C. 154(b) by 276 days.

(21) Appl. No.: 14/112,871

(22) PCT Filed: Apr. 9, 2012

(86) PCT No.: PCT/JP2012/059671

§ 371 (c)(1),
(2), (4) Date: Oct. 18, 2013

(87) PCT Pub. No.: WO2012/144365

PCT Pub. Date: Oct. 26, 2012

(65) Prior Publication Data

US 2014/0041763 A1 Feb. 13, 2014

(30) Foreign Application Priority Data

Apr. 19, 2011 (JP) ..... 2011-093127

(51) Int. Cl.

| | |
|---|---|
| ***C21D 1/06*** | (2006.01) |
| ***C23C 8/32*** | (2006.01) |
| ***C21D 1/74*** | (2006.01) |
| ***C21D 1/76*** | (2006.01) |
| ***C21D 9/36*** | (2006.01) |
| ***C21D 9/38*** | (2006.01) |
| ***C21D 9/40*** | (2006.01) |
| ***C23C 8/26*** | (2006.01) |

(52) U.S. Cl.

CPC ..... *C23C 8/32* (2013.01); *C21D 1/06* (2013.01); *C21D 1/74* (2013.01); *C21D 1/76* (2013.01); *C21D 9/36* (2013.01); *C21D 9/38* (2013.01); *C21D 9/40* (2013.01); *C23C 8/26* (2013.01)

(58) Field of Classification Search

CPC ..... C22C 38/02; C22C 38/04; C21D 1/06
See application file for complete search history.

(56) References Cited

U.S. PATENT DOCUMENTS

| | | | | |
|---|---|---|---|---|
| 4,496,401 | A * | 1/1985 | Dawes | C21D 9/0068 148/217 |
| 2006/0147296 | A1 | 7/2006 | Torizuka et al. | |
| 2009/0101240 | A1 | 4/2009 | Ohki | |
| 2012/0080122 | A1 | 4/2012 | Chida et al. | |

FOREIGN PATENT DOCUMENTS

| | | | |
|---|---|---|---|
| CN | 1705758 | A | 12/2005 |
| CN | 200380101516 | | 12/2005 |
| DE | 222416 | A1 | 5/1985 |
| DE | 3937699 | A1 | 5/1991 |
| DE | 19652125 | C1 | 4/1998 |
| JP | S58-174572 | | 10/1983 |
| JP | 9-279296 | H | 10/1997 |
| JP | 2002-069609 | A | 3/2002 |
| JP | 2003-119548 | A | 4/2003 |
| JP | 2004-137560 | A | 5/2004 |
| JP | 2009-041063 | A | 2/2009 |
| JP | 2010-58164 | A | 3/2010 |
| JP | 2011-26627 | A | 2/2011 |
| WO | 2010/147224 | A1 | 12/2010 |

OTHER PUBLICATIONS

Pye, David. (2003). Practical Nitriding and Ferritic Nitrocarburizing—5. Furnace Equipment and Control Systems, 20. Gaseous Ferritic Nitrocarburizing. ASM International. pp. 39-52, 219-230.*

English Machine Translation of "Investigation of Partial Pressure Distribution of Undecomposed NH 3 in Carbonitiriding Atmosphere", of Chikara Ohki, Journal of the Iron and Steel Institute of Japan, Feb. 25, 2008, vol. 94, No. 2, pp. 8-16.*

English machine translation of DE 19652125 C1 of Leverkus (Year: 1998).*

Supplementary European Search Report EP 12 77 4037 dated Sep. 14, 2014.

Office Action Chinese Application No. 201280018454.0 dated Jan. 7, 2015 with full English translation.

Kazuki Kawata, "New Technology of Carburization and Nitridation", Foreign Locaomotive & Rolling Stock Technology, Issue 6, Nov. 2008, pp. 24-25.

Kazuki Kawata, "New Technology of Carburization and Nitridation", Foreign Locamotive & Rolling Stock Technology, Issue 6, Nov. 2008, pp. 24-25.

International Search Report PCT/JP2012/059671 dated May 22, 2012.

Chikara Ohki, "Investigation of Partial Pressure Distribution of Undecomposed NH 3 in Carbonitiriding Atmosphere", Journal of the Iron and Steel Institute of Japan, Feb. 25, 2008, vol. 94, No. 2, pp. 8-16 w/English Abstract.

Taizo Hara, "Design and Facts of Heat Treatment Furnace", Shin-Nihon Casting and Forging Press, Mar. 1998, pp. 185-188 w/partial English trnaslation.

Karl-Michael Winter et al., "State-of-the-Art Controlled Nitriding and Nitrocarburizing", Technical Paper, 2010, United Process Controls, pp. 1-10.

(Continued)

*Primary Examiner* — Jessee R Roe

*Assistant Examiner* — Jophy S. Koshy

(74) *Attorney, Agent, or Firm* — McDermott Will & Emery LLP

(57) ABSTRACT

Provided is a gas nitrocarburizing method forming a nitride layer in a surface layer portion of a workpiece made of steel by heating the workpiece within a heat treatment furnace into which a heat treatment gas is introduced, the heat treatment gas containing ammonia gas and at least one of carbon dioxide gas and hydrogen gas, and having a remainder formed of an impurity.

2 Claims, 4 Drawing Sheets

(56) References Cited

OTHER PUBLICATIONS

"Chapter 6—Nitriding" in J.R. Davis, Davis & Associates: "Surface Hardening of Steels—Understanding the Basics", Nov. 2002, ASM International, pp. 165-166.
Office Action issued in corresponding European Patent Application No. 12774037.1, dated Jun. 9, 2017.
Office Action issued in corresponding European Patent Application No. 12774037.1, dated Mar. 12, 2018.

* cited by examiner

GAS NITROCARBURIZING METHOD AND METHOD FOR MANUFACTURING BEARING PART

CLAIM TO CONVENTION PRIORITY

This application is the U.S. National Phase of PCT/JP2012/059671 filed Apr. 9, 2012 which claims priority from Japanese Patent Application No. 2011-093127 filed Apr. 19, 2011 each of which are incorporated herein by entirety.

TECHNICAL FIELD

The present invention relates to a gas nitrocarburizing method and a method for manufacturing a bearing part. More particularly, the present invention relates to a gas nitrocarburizing method and a method for manufacturing a bearing part capable of implementing both cost reduction and reduction of variation in quality.

BACKGROUND ART

Gas nitrocarburizing processing has been known as treatment for improving wear resistance of a part made of steel by forming a nitride layer in a surface layer portion of the part. More specifically, in the gas nitrocarburizing processing, a part made of steel is brought into contact with, for example, ammonia gas in a temperature range of less than or equal to an austenite transformation point of the steel, to form an iron nitride layer in a surface layer portion of the part. Since the nitride layer has an extremely high hardness, the gas nitrocarburizing processing has been widely used as heat treatment for improving wear resistance of parts.

The above gas nitrocarburizing processing is performed by placing a workpiece within a heat treatment furnace and heating the workpiece in an atmosphere containing ammonia gas. There have been known methods such as a method of introducing ammonia gas only into a heat treatment furnace as a heat treatment gas for forming an atmosphere (see, for example, Taizo Hara, "Design and Facts of Heat Treatment Furnace", Shin-Nihon Casting & Forging Press, March 1998, pp. 185 to 188 (Non Patent Document 1)), a method of adopting a heat treatment gas prepared by adding ammonia gas to nitrogen gas as a base gas, a method of adopting a heat treatment gas prepared by adding ammonia gas to an endothermic converted gas as a base gas, and the like (see, for example, Japanese Patent Laying-Open No. 2002-69609 (Patent Document 1) and Japanese Patent Laying-Open No. 58-174572 (Patent Document 2)).

CITATION LIST

Patent Document

PTD 1: Japanese Patent Laying-Open No. 2002-69609
PTD 2: Japanese Patent Laying-Open No. 58-174572

Non-Patent Document

NPD 1: Taizo Hara, "Design and Facts of Heat Treatment Furnace", Shin-Nihon Casting & Forging Press, March 1998, pp. 185 to 188

SUMMARY OF INVENTION

Technical Problem

The method of introducing ammonia gas only into a heat treatment furnace as a heat treatment gas for forming an atmosphere has a problem that cost for heat treatment is increased because the amount of usage of the ammonia gas is increased. This method also has a problem that workpieces subjected to heat treatment vary widely in quality depending on the position within the heat treatment furnace. In contrast, with the method of adopting a heat treatment gas prepared by adding ammonia gas to nitrogen gas as a base gas, cost for heat treatment can be reduced by suppressing the amount of usage of the ammonia gas. However, this method still has the problem of variation described above. On the other hand, with the method of adopting a heat treatment gas prepared by adding ammonia gas to an endothermic converted gas as a base gas, the variation described above can be reduced. However, this method requires cost for maintaining a conversion furnace for producing the endothermic converted gas, cost for a source gas such as propane, and the like. Thus, this method has a problem that it is difficult to reduce cost for heat treatment. Namely, conventional gas nitrocarburizing methods have had a problem that it is difficult to implement both cost reduction and reduction of variation in quality.

Accordingly, one object of the present invention is to provide a gas nitrocarburizing method and a method for manufacturing a bearing part capable of implementing both cost reduction and reduction of variation in quality.

Solution to Problem

A gas nitrocarburizing method in accordance with a first aspect of the present invention is a gas nitrocarburizing method forming a nitride layer in a surface layer portion of a workpiece made of steel by heating the workpiece within a heat treatment furnace into which a heat treatment gas is introduced. The heat treatment gas contains ammonia gas and at least one of carbon dioxide gas and hydrogen gas, and has a remainder formed of an impurity.

Further, a gas nitrocarburizing method in accordance with a second aspect of the present invention is a gas nitrocarburizing method forming a nitride layer in a surface layer portion of a workpiece made of steel by heating the workpiece within a heat treatment furnace into which a heat treatment gas is introduced. The heat treatment gas contains ammonia gas, at least one of carbon dioxide gas and hydrogen gas, and nitrogen gas, and has a remainder formed of an impurity.

The inventor of the present invention has conducted a study for a gas nitrocarburizing method capable of implementing both cost reduction and reduction of variation in quality. As a result, the inventor has obtained the finding as described below and arrived at the present invention.

Specifically, ammonia ($NH_3$) is a gas which is stable at ordinary temperatures and pressures. However, when ammonia is exposed to a high temperature, ammonia is decomposed into nitrogen ($N_2$) and hydrogen ($H_2$) by a decomposition reaction represented by formula (1):

$$NH_3 \rightarrow 1/2N_2 + 3/2H_2 \quad (1).$$

Here, nitrogen gas is inert to steel, and ammonia on the left-hand side of reaction formula (1), that is, undecomposed ammonia as ammonia prior to decomposition, contributes to nitriding of the steel. Thus, by slowing down a speed of the decomposition reaction of ammonia represented by reaction formula (1), the amount of usage of ammonia gas can be reduced, and manufacturing cost can be suppressed.

Further, variation in the quality of workpieces subjected to heat treatment is considered to be because the decomposition reaction of ammonia is in a state of non-equilibrium within a heat treatment furnace. Specifically, since the decomposition reaction is in a state of non-equilibrium, the degree of progress of the decomposition reaction differs depending on the position within the heat treatment furnace, resulting in different undecomposed ammonia fractions. It is considered that, as a result, workpieces subjected to heat treatment vary in quality depending on the position within the furnace. Therefore, by slowing down the decomposition reaction speed described above, a difference in the undecomposed ammonia fraction caused depending on the position within the heat treatment furnace is decreased, and variation in the quality of workpieces subjected to heat treatment can be reduced.

Namely, in order to implement both cost reduction and reduction of variation in quality, it is considered effective to add a negative catalyst which slows down the decomposition reaction of ammonia. In addition, the inventor of the present invention has found through the study that, by adding one or both of carbon dioxide gas and hydrogen gas as a negative catalyst to a heat treatment gas, the speed of the decomposition reaction of ammonia can be effectively slowed down, and variation in the undecomposed ammonia fraction in an atmosphere within the heat treatment furnace can be reduced. Further, hydrogen gas is relatively inexpensive because it is used in a large quantity in food industry and the like. Furthermore, since carbon dioxide gas is one of greenhouse gases, it is expected that separation and collection thereof will be further promoted and its price will be reduced in the future. Thus, addition of hydrogen gas and carbon dioxide gas to the heat treatment gas can be achieved relatively inexpensively. Therefore, with the gas nitrocarburizing method in accordance with the present invention, in which at least one of carbon dioxide gas and hydrogen gas is added to the heat treatment gas, both cost reduction and reduction of variation in quality can be implemented.

In the gas nitrocarburizing method, a ratio of a flow rate of the carbon dioxide gas to a total flow rate of the heat treatment gas introduced into the heat treatment furnace may be more than or equal to 5% and less than or equal to 20%.

As the ratio of the flow rate of the carbon dioxide gas to the total flow rate of the heat treatment gas increases, the speed of the decomposition reaction of ammonia slows down. Until the above ratio reaches 5%, a reduction in the decomposition speed clearly progresses. Accordingly, the above ratio is preferably more than or equal to 5%. On the other hand, when the above ratio exceeds 20%, the effect of reducing the speed of decomposing ammonia caused by adding carbon dioxide may be offset by a reduction in ammonia gas concentration caused by adding carbon dioxide. Accordingly, the above ratio is preferably less than or equal to 20%.

In the gas nitrocarburizing method, a ratio of a flow rate of the hydrogen gas to a total flow rate of the heat treatment gas introduced into the heat treatment furnace may be more than or equal to 10% and less than or equal to 50%.

As the ratio of the flow rate of the hydrogen gas to the total flow rate of the heat treatment gas increases, the speed of the decomposition reaction of ammonia slows down. Until the above ratio reaches 10%, a reduction in the decomposition speed clearly progresses. Accordingly, the above ratio is preferably more than or equal to 10%. On the other hand, when the above ratio exceeds 50%, the effect of reducing the speed of decomposing ammonia caused by adding hydrogen may be offset by a reduction in ammonia gas concentration caused by adding hydrogen. Accordingly, the above ratio is preferably less than or equal to 50%.

In the gas nitrocarburizing method, the nitride layer may be formed by heating the workpiece to a temperature range of more than or equal to 550° C. and less than or equal to 650° C. within the heat treatment furnace. By adopting a heating temperature of more than or equal to 550° C. and less than or equal to 650° C., a high-quality nitride layer can be easily formed by nitrocarburizing processing using ammonia gas.

In the gas nitrocarburizing method, an atmosphere within the heat treatment furnace may be obtained at a plurality of positions to control an undecomposed ammonia fraction in the atmosphere.

As described above, undecomposed ammonia contributes to formation of a nitride layer. In addition, the degree of progress of the decomposition reaction differs depending on the position within the heat treatment furnace, resulting in different undecomposed ammonia fractions. Thus, by obtaining an atmosphere within the heat treatment furnace at a plurality of positions and controlling an undecomposed ammonia fraction in the atmosphere, variation in the quality of workpieces subjected to heat treatment can be reduced more reliably.

In the gas nitrocarburizing method, the undecomposed ammonia fraction in the atmosphere may be controlled such that a difference between a maximum value and a minimum value of the undecomposed ammonia fraction in the atmosphere obtained at the plurality of positions within the heat treatment furnace is less than or equal to 0.8% by volume. Thereby, variation in the quality of workpieces subjected to heat treatment can be reduced further reliably.

In the gas nitrocarburizing method, the undecomposed ammonia fraction in the atmosphere may be adjusted by adjusting a flow rate of the at least one of the carbon dioxide gas and the hydrogen gas in the heat treatment gas. Thereby, the undecomposed ammonia fraction in the atmosphere can be easily adjusted. In particular, by adjusting the flow rate of the at least one of the carbon dioxide gas and the hydrogen gas in the heat treatment gas so as to reduce the difference between the maximum value and the minimum value of the undecomposed ammonia fraction in the atmosphere obtained at the plurality of positions within the heat treatment furnace, variation in the quality of workpieces subjected to heat treatment can be easily reduced.

In the gas nitrocarburizing method, the workpiece may be heated within the heat treatment furnace with an atmosphere within the heat treatment furnace being stirred by a stirring fan arranged within the heat treatment furnace. Thereby, variation in the quality of workpieces subjected to heat treatment can be reduced further easily.

A method for manufacturing a bearing part in accordance with the present invention includes the steps of preparing a steel material, fabricating a shaped member by shaping the steel material; and forming a nitride layer in a surface layer portion of the shaped member. In the step of forming the nitride layer, the nitride layer is formed by the gas nitrocarburizing method in accordance with the present invention. With the method for manufacturing a bearing part in accordance with the present invention, a method for manufacturing a bearing part capable of implementing both cost reduction and reduction of variation in quality can be provided by forming a nitride layer by the gas nitrocarburizing method in accordance with the present invention.

It is noted that the total flow rate of the heat treatment gas can be set to about 1 to 5 times of the volume of the heat treatment furnace per hour at ordinary temperatures and pressures.

Advantageous Effects of Invention

As is clear from the above description, with the gas nitrocarburizing method and the method for manufacturing a bearing part in accordance with the present invention, a gas nitrocarburizing method and a method for manufacturing a bearing part capable of implementing both cost reduction and reduction of variation in quality can be provided.

DESCRIPTION OF EMBODIMENTS

Figure 1:
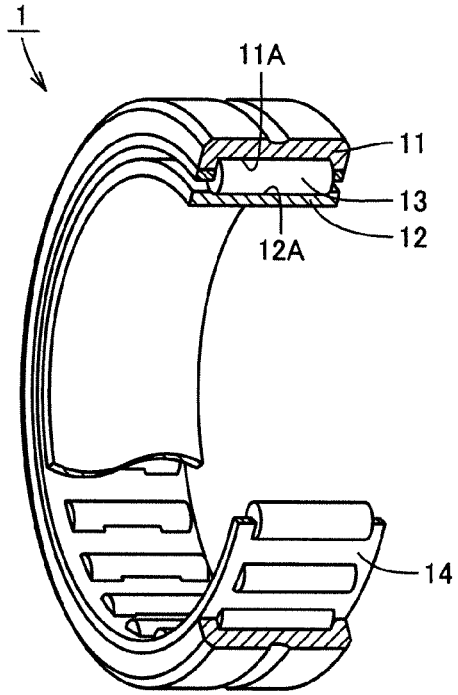
FIG. 1 is a schematic view showing a structure of a radial needle roller bearing.

Hereinafter, an embodiment of the present invention will be described with reference to the drawings. In the drawings below, identical or corresponding parts will be designated by the same reference numerals, and the description thereof will not be repeated.

Referring to FIG. 1, a radial needle roller bearing 1 as a rolling bearing in the present embodiment includes an annular outer race 11, an annular inner race 12 arranged inside outer race 11, and a plurality of needle rollers 13 as rolling elements arranged between outer race 11 and inner race 12 and held in an annular cage 14. An outer race rolling surface 11A is formed on an inner peripheral surface of outer race 11, and an inner race rolling surface 12A is formed on an outer peripheral surface of inner race 12. Outer race 11 and inner race 12 are arranged such that inner race rolling surface 12A and outer race rolling surface 11A face each other. Further, the plurality of needle rollers 13 each have an outer peripheral surface 13A in contact with inner race rolling surface 12A and outer race rolling surface 11A, and are arranged by cage 14 at a prescribed pitch in a circumferential direction, to be held on an annular raceway in a rollable manner. With the above structure, outer race 11 and inner race 12 of radial needle roller bearing 1 are relatively rotatable with respect to each other.

Figure 2:
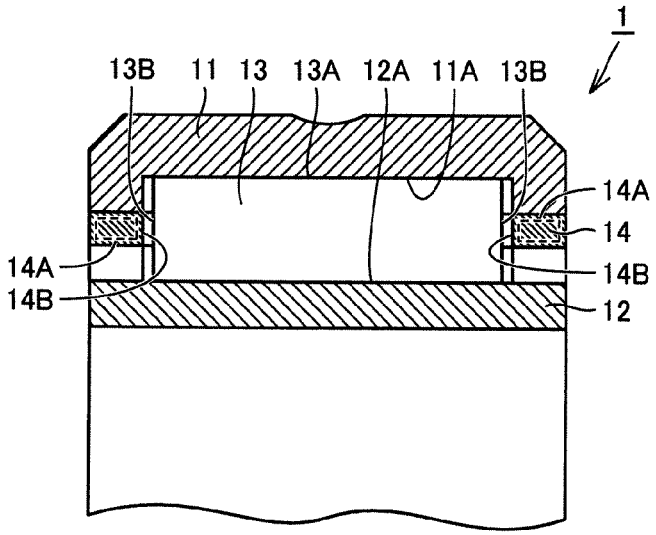
FIG. 2 is a schematic cross sectional view showing the structure of the radial needle roller bearing in an enlarged manner.

Referring now to FIG. 2, cage 14 as a bearing part holding needle roller 13 has an end surface holding surface 14B facing an end surface 13B of needle roller 13. Since end surface holding surface 14B is subjected to drilling wear by end surface 13B of needle roller 13, it is required to have a high wear resistance. Thus, cage 14 in the present embodiment has a nitride layer 14A formed by gas nitrocarburizing in a surface layer portion thereof, and thereby end surface 13B is provided with a high wear resistance. Nitride layer 14A is formed by a gas nitrocarburizing method in one embodiment of the present invention described below.

Figure 3:
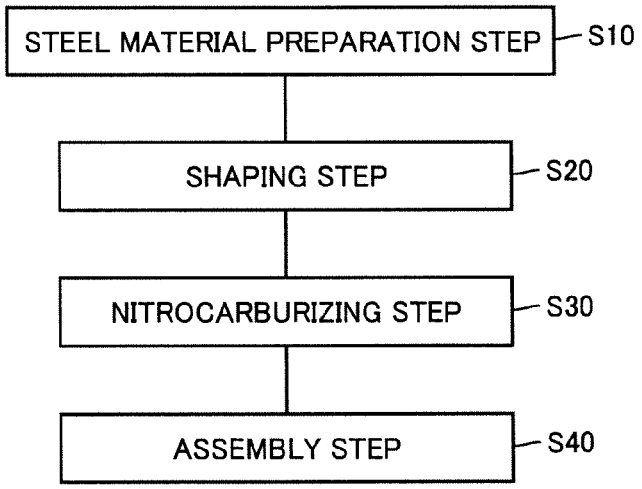
FIG. 3 is a flowchart schematically showing a method for manufacturing the radial needle roller bearing.

Referring to FIG. 3, in a method for manufacturing radial needle roller bearing 1 including cage 14 in the present embodiment, firstly, a steel material preparation step is performed as a step (S10). In this step (S10), for example, a JIS SPCC material as a cold-rolled steel strip or a JIS SPHD material as a hot-rolled soft steel strip is prepared.

Next, a shaping step is performed as a step (S20). In this step (S20), the prepared steel strip is shaped into a desired shape to fabricate a shaped member having the shape of cage 14. Specifically, processes such as formation of pockets for holding the needle rollers, bending of the steel strip into the shape of the annular cage, and the like are performed.

Next, a nitrocarburizing step is performed as a step (S30). In this step (S30), the shaped member is heated within a heat treatment furnace into which a heat treatment gas is introduced, to form a nitride layer in a surface layer portion of the shaped member. On this occasion, as the heat treatment gas, a heat treatment gas containing ammonia gas, at least one of carbon dioxide gas and hydrogen gas, and nitrogen gas, and having the remainder formed of an impurity is used. It is noted that the nitrogen gas is not essential in the heat treatment gas, and, by omitting the nitrogen gas, a heat treatment gas containing ammonia gas and at least one of carbon dioxide gas and hydrogen gas, and having the remainder formed of an impurity may be used.

In the gas nitrocarburizing method in the present embodiment, since at least one of carbon dioxide gas and hydrogen gas is added to the heat treatment gas, gas nitrocarburizing processing implementing both cost reduction and reduction of variation in quality can be achieved. As a result, cage 14 fabricated to have nitride layer 14A formed on the shaped member serves as a cage implementing both reduction of cost for heat treatment and reduction of variation in quality.

Next, an assembly step is performed as a step (S40). In this step (S40), cage 14 fabricated as described above is combined with outer race 11, inner race 12, needle rollers 13, and the like prepared separately, to assemble radial needle roller bearing 1.

Preferably, in step (S30), a ratio of a flow rate of the carbon dioxide gas to a total flow rate of the heat treatment gas introduced into the heat treatment furnace is more than or equal to 5% and less than or equal to 20%. Thereby, a speed of a decomposition reaction of ammonia can be sufficiently reduced.

Preferably, in step (S30), a ratio of a flow rate of the hydrogen gas to the total flow rate of the heat treatment gas introduced into the heat treatment furnace is more than or equal to 10% and less than or equal to 50%. Thereby, the speed of the decomposition reaction of ammonia can be sufficiently reduced.

Preferably, in step (S30), nitride layer 14A is formed by heating the shaped member to a temperature range of more than or equal to 550° C. and less than or equal to 650° C. within the heat treatment furnace. Thereby, high-quality nitride layer 14A can be easily formed.

Preferably, in step (S30), an atmosphere within the heat treatment furnace is obtained at a plurality of positions to control an undecomposed ammonia fraction in the atmosphere. More specifically, the undecomposed ammonia fraction in the atmosphere is preferably controlled such that, for example, a difference between a maximum value and a minimum value of the undecomposed ammonia fraction in the atmosphere obtained at the plurality of positions within the heat treatment furnace is less than or equal to 0.8% by volume. Thereby, variation in the quality of cages 14 can be reduced more reliably.

On this occasion, the undecomposed ammonia fraction in the atmosphere is preferably adjusted by adjusting a flow rate of the at least one of the carbon dioxide gas and the hydrogen gas in the heat treatment gas. Thereby, the undecomposed ammonia fraction in the atmosphere can be easily adjusted. In particular, by adjusting the flow rate of the at least one of the carbon dioxide gas and the hydrogen gas in the heat treatment gas so as to reduce the difference between the maximum value and the minimum value of the undecomposed ammonia fraction in the atmosphere obtained at the plurality of positions within the heat treatment furnace, variation in the quality of cages 14 can be easily reduced.

Preferably, in step (S30), the shaped member is heated within the heat treatment furnace with an atmosphere within the heat treatment furnace being stirred by a stirring fan arranged within the heat treatment furnace. Thereby, variation in the quality of cages 14 can be reduced further easily.

Example

Hereinafter, an example of the present invention will be described. An experiment was conducted to confirm the effect caused by adding at least one of carbon dioxide gas and hydrogen gas to a heat treatment gas in gas nitrocarburizing processing. The procedure of the experiment was as follows.

In gas nitrocarburizing processing using a heat treatment gas prepared by adding ammonia gas to nitrogen gas as a base gas, at least one of carbon dioxide gas and hydrogen gas was further added to the heat treatment gas to investigate the influence of the addition on an undecomposed ammonia fraction.

Figure 4:
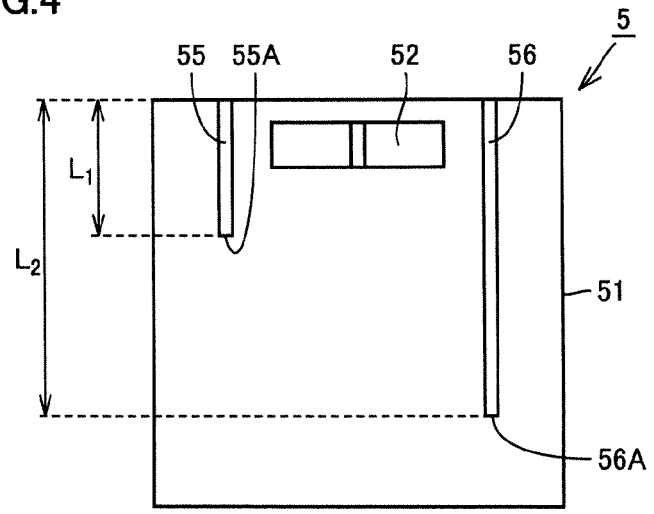
FIG. 4 is a schematic cross sectional view of a heat treatment furnace in a cross section perpendicular to an upper wall and a bottom wall of a reaction chamber.
Figure 5:
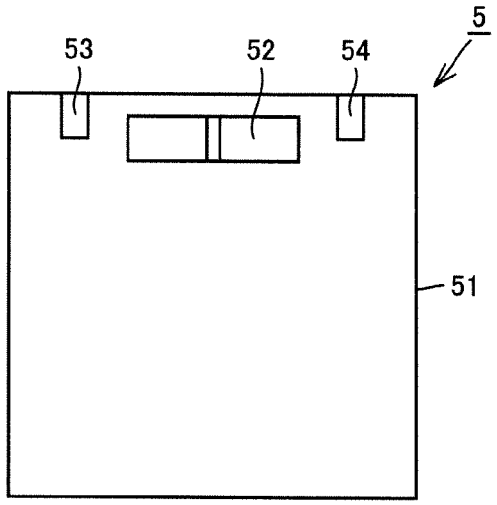
FIG. 5 is a schematic cross sectional view of the heat treatment furnace in a cross section perpendicular to the cross section in FIG. 4 and perpendicular to the upper wall and the bottom wall of the reaction chamber.

FIGS. 4 and 5 show a heat treatment furnace used for the experiment. Referring to FIGS. 4 and 5, a heat treatment furnace 5 is a heat treatment furnace capable of holding a workpiece within a reaction chamber 51 and performing the gas nitrocarburizing processing on the workpiece. Reaction chamber 51 has a shape with a diameter of 460 mm and a height of 700 mm. A stirring fan 52 is provided on an upper wall of reaction chamber 51. The experiment was conducted with stirring fan 52 being always operated at a rotation speed of 1600 rpm. Further, as shown in FIG. 4, reaction chamber 51 is provided with a first sampling tube 55 and a second sampling tube 56 extending from the upper wall toward a bottom wall. Further, referring to FIG. 5, reaction chamber 51 is provided with a gas inlet 53 for introducing ammonia gas, nitrogen gas, carbon dioxide gas, and hydrogen gas into reaction chamber 51, and an exhaust outlet 54 exhausting the gas within reaction chamber 51 to the outside. In addition, as shown in FIG. 4, an opening 55A of first sampling tube 55 for obtaining an atmosphere within reaction chamber 51 is located in a region having a distance $L_1$ from the upper wall of 300 mm. Further, an opening 56A of second sampling tube 56 is located in a region having a distance $L_2$ from the upper wall of 500 mm. Thereby, first sampling tube 55 and second sampling tube 56 can obtain the atmosphere within reaction chamber 51 in an upper region and a lower region, respectively.

Then, a constant amount of ammonia gas was introduced into reaction chamber 51, and carbon dioxide gas, hydrogen gas, and nitrogen gas were introduced with flow rates thereof being changed so as to obtain a constant total flow rate of the heat treatment gas, to analyze the undecomposed ammonia fraction within reaction chamber 51 obtained from first sampling tube 55 and second sampling tube 56. The temperature of the atmosphere within reaction chamber 51 was set at two levels, that is, 550° C. and 650° C., which are suitable for the gas nitrocarburizing processing.

The undecomposed ammonia fraction was analyzed with a non-dispersive infrared gas analyzer (FA1000 manufactured by Horiba, Ltd.). It is noted that the experiment was conducted with the analyzer and the sampling tubes being kept at more than or equal to 65° C. using a band heater and a heat insulating material in order to avoid solid ammonium carbonate from being produced within the analyzer and the sampling tubes and affecting the experiment. Table 1 shows experimental conditions, and Table 2 shows experimental results.

TABLE 1

| | | | $NH_3$ | | $H_2$ | | $CO_2$ | |
|---|---|---|---|---|---|---|---|---|
| | Heating temperature (° C.) | Total flow rate (L/min) | flow rate (L/min) | $N_2$ flow rate (L/min) | flow rate (L/min) | flow rate ratio (%) | flow rate (L/min) | flow rate ratio (%) |
| 1 | 550 | 6 | 3 | 3 | 0 | 0 | 0 | 0 |
| 2 | 550 | 6 | 3 | 1.8 | 1.2 | 20 | 0 | 0 |
| 3 | 550 | 6 | 3 | 2.7 | 0 | 0 | 0.3 | 5 |
| 4 | 550 | 6 | 3 | 1.5 | 1.2 | 20 | 0.3 | 5 |
| 5 | 550 | 6 | 3 | 1.8 | 0 | 0 | 1.2 | 20 |
| 6 | 550 | 6 | 3 | 0.6 | 1.2 | 20 | 1.2 | 20 |
| 7 | 650 | 6 | 3 | 3 | 0 | 0 | 0 | 0 |
| 8 | 650 | 6 | 3 | 1.8 | 1.2 | 20 | 0 | 0 |
| 9 | 650 | 6 | 3 | 2.7 | 0 | 0 | 0.3 | 5 |
| 10 | 650 | 6 | 3 | 1.5 | 1.2 | 20 | 0.3 | 5 |
| 11 | 650 | 6 | 3 | 1.8 | 0 | 0 | 1.2 | 20 |
| 12 | 650 | 6 | 3 | 0.6 | 1.2 | 20 | 1.2 | 20 |

TABLE 2

| | | Undecomposed $NH_3$ fraction (% by volume) | | | |
|---|---|---|---|---|---|
| | Temperature (° C.) | Measurement point A (distance from upper wall: 300 mm) | Measurement point B (distance from upper wall: 500 mm) | Average | Variation |
| 1 | 550 | 30.8 | 30.8 | 30.8 | 0.0 |
| 2 | 550 | 37.1 | 37.0 | 37.1 | 0.1 |
| 3 | 550 | 35.3 | 35.4 | 35.4 | 0.1 |

TABLE 2-continued

| | Temperature (° C.) | Undecomposed $NH_3$ fraction (% by volume) Measurement point A (distance from upper wall: 300 mm) | Measurement point B (distance from upper wall: 500 mm) | Average | Variation |
|---|---|---|---|---|---|
| 4 | 550 | 39.8 | 39.8 | 39.8 | 0.0 |
| 5 | 550 | 34.2 | 34.2 | 34.2 | 0.0 |
| 6 | 550 | 39.4 | 39.4 | 39.4 | 0.0 |
| 7 | 650 | 6.4 | 4.9 | 5.7 | 1.5 |
| 8 | 650 | 8.0 | 7.3 | 7.7 | 0.7 |
| 9 | 650 | 7.4 | 6.6 | 7.0 | 0.8 |
| 10 | 650 | 8.8 | 8.3 | 8.6 | 0.5 |
| 11 | 650 | 7.3 | 7.0 | 7.2 | 0.3 |
| 12 | 650 | 9.2 | 9.0 | 9.1 | 0.2 |

Referring to Tables 1 and 2, although the total flow rate of the heat treatment gas and the flow rate of the ammonia gas were identical, undecomposed ammonia fractions at a heating temperature of 650° C. are reduced to about one fifth of those at a heating temperature of 550° C. This is considered to be because an increase in temperature causes an increase in a reaction speed of the decomposition reaction represented by formula (1).

Figure 6:
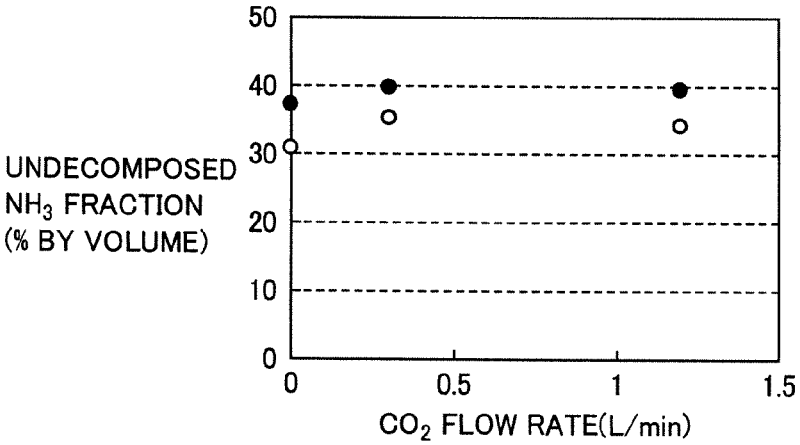
FIG. 6 is a view showing the influence of flow rates of carbon dioxide gas and hydrogen gas on an undecomposed ammonia fraction.
Figure 7:
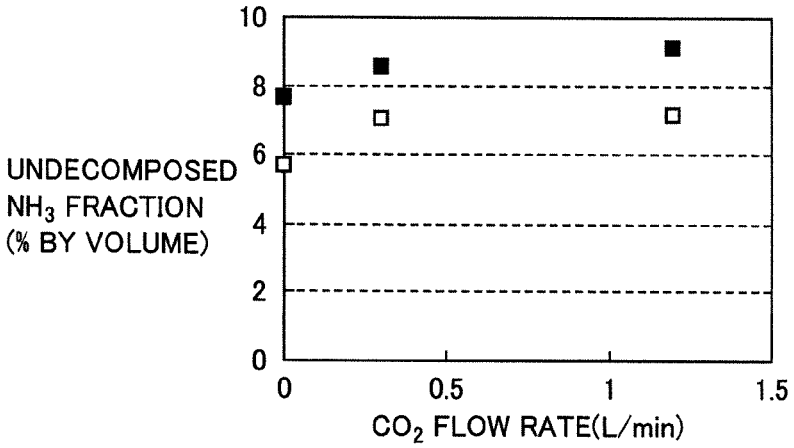
FIG. 7 is a view showing the influence of flow rates of carbon dioxide gas and hydrogen gas on an undecomposed ammonia fraction.

Next, the above experimental results are depicted in graph form to analyze the experimental results. FIGS. 6 and 7 are views showing the relation between the flow rate of carbon dioxide and the undecomposed ammonia fraction at heating temperatures of 550° C. and 650° C., respectively. In FIGS. 6 and 7, a hollow data point indicates a value in a case where the flow rate of the hydrogen gas was 0, and a solid data point indicates a value in a case where the flow rate of the hydrogen gas was 1.2 L/min. Further, in FIGS. 6 and 7, the axis of abscissas represents the flow rate of the carbon dioxide gas, and the axis of ordinates represents the undecomposed ammonia fraction. An undecomposed ammonia fraction on the axis of ordinates indicates an average value of analysis values of the atmosphere respectively obtained at first sampling tube 55 and second sampling tube 56.

Referring to FIGS. 6 and 7, in the case where the flow rate of the hydrogen gas is 1.2 L/min, the value of the undecomposed ammonia fraction is clearly increased when compared with that in the case where the flow rate of the hydrogen gas is 0. This is considered to indicate that the speed of the decomposition reaction of the ammonia gas was reduced by adding the hydrogen gas to the heat treatment gas, and more undecomposed ammonia remained within reaction chamber 51. Based on this, it is considered that the hydrogen gas serves as a negative catalyst which slows down the speed of the decomposition reaction of the ammonia gas in the heat treatment gas for the gas nitrocarburizing processing, and the amount of usage of the ammonia gas can be reduced by adding the hydrogen gas.

Further, referring to FIGS. 6 and 7, the undecomposed ammonia fraction increases as the flow rate of the carbon dioxide gas increases. Based on this, it is considered that the carbon dioxide gas also serves as a negative catalyst which slows down the speed of the decomposition reaction of the ammonia gas in the heat treatment gas for the gas nitrocarburizing processing, and the amount of usage of the ammonia gas can be reduced by adding the carbon dioxide gas. More specifically, referring to Tables 1 and 2, the undecomposed ammonia fractions under conditions 6 and 12 in which the flow rates of the hydrogen gas and the carbon dioxide gas were set to maximum within the range of the experiment this time are increased by 28% and 60%, respectively, when compared with those under conditions 1 and 7 in which the hydrogen gas and the carbon dioxide gas were not added. Based on the above results, it has been confirmed that, by adding the carbon dioxide gas and the hydrogen gas to the heat treatment gas in the gas nitrocarburizing processing, the amount of usage of expensive ammonia gas can be considerably reduced, and reduction of cost for heat treatment can be achieved.

Figure 8:
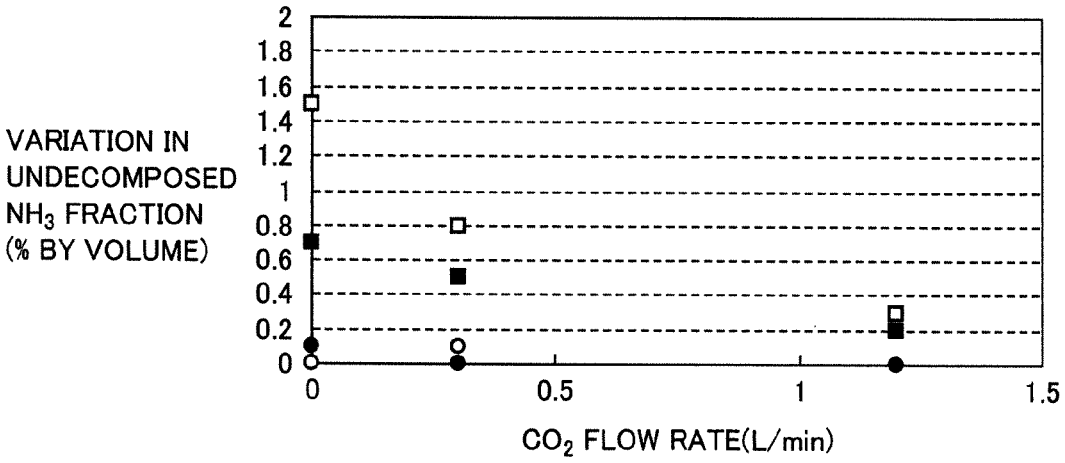
FIG. 8 is a view showing the influence of the flow rates of the carbon dioxide gas and the hydrogen gas on variation in the undecomposed ammonia fraction.

Next, the influence of adding the carbon dioxide gas and the hydrogen gas on variation in the undecomposed ammonia fraction within the heat treatment furnace will be discussed with reference to FIG. 8. In FIG. 8, the axis of abscissas represents the flow rate of carbon dioxide, and the axis of ordinates represents variation in the undecomposed ammonia fraction. A variation in the undecomposed ammonia fraction on the axis of ordinates indicates a difference between an undecomposed ammonia fraction in the atmosphere obtained at first sampling tube 55 and an undecomposed ammonia fraction in the atmosphere obtained at second sampling tube 56. Further, in FIG. 8, a circular data point indicates a value at a heating temperature of 550° C., and a square data point indicates a value at a heating temperature of 650° C. Furthermore, in FIG. 8, a hollow data point indicates a value in the case where the flow rate of the hydrogen gas was 0, and a solid data point indicates a value in the case where the flow rate of the hydrogen gas was 1.2 L/min.

Referring to FIG. 8, at a heating temperature of 550° C., variation in the undecomposed ammonia fraction within reaction chamber 51 is small regardless of whether the carbon dioxide gas and the hydrogen gas were added. On the other hand, at a heating temperature of 650° C., under a condition in which carbon dioxide and hydrogen were not added, the undecomposed ammonia fraction varies significantly within the furnace. This is considered to be because, at a heating temperature of 650° C., the speed of the decomposition reaction of the ammonia gas was increased, and the undecomposed ammonia fraction was relatively increased in the upper region close to gas inlet 53 for introducing the ammonia gas. In contrast, at a heating temperature of 650° C., the variation is reduced when any of the flow rates of the carbon dioxide gas and the hydrogen gas is increased. In addition, it has been found that, under condition 12 in which the flow rates of the carbon dioxide gas and the hydrogen gas were both set to 1.2 L/min, the variation is reduced to 0.2% by volume. Based on this, it has been confirmed that, by adding at least one of the carbon dioxide gas and the hydrogen gas to the heat treatment gas, variation in the undecomposed ammonia fraction within the heat treatment furnace can be reduced, and variation in quality can be suppressed.

It is noted that there are many substances serving as a negative catalyst which slows down the speed of the decomposition reaction of the ammonia gas. However, considering that reduction of environmental load and suppression of manufacturing cost are preferable, it is desirable that a negative catalyst to be adopted does not contain chlorine and the like which do not exist much in the air, and is inexpensive. From such a viewpoint, it can be said that the gas nitrocarburizing method in accordance with the present invention adopting at least one of carbon dioxide and hydrogen as a negative catalyst is an effective gas nitrocarburizing method.

It should be understood that the embodiment and the example disclosed herein are illustrative and non-restrictive in every respect. The scope of the present invention is defined by the scope of the claims, rather than the description above, and is intended to include any modifications within the scope and meaning equivalent to the scope of the claims.

INDUSTRIAL APPLICABILITY

The gas nitrocarburizing method and the method for manufacturing a bearing part in accordance with the present invention are particularly advantageously applicable to a gas nitrocarburizing method and a method for manufacturing a bearing part which are required to implement both cost reduction and reduction of variation in quality.

REFERENCE SIGNS LIST

1: radial needle roller bearing; 5: heat treatment furnace; 11: outer race; 11A: outer race rolling surface; 12: inner race; 12A: inner race rolling surface; 13: needle roller; 13A: outer peripheral surface; 13B: end surface; 14: cage; 14A: nitride layer; 14B: end surface holding surface; 51: reaction chamber; 52: stirring fan; 53: gas inlet; 54: exhaust outlet; 55: first sampling tube; 55A, 56A: opening; 56: second sampling tube.

The invention claimed is:

1. A gas nitrocarburizing method forming a nitride layer in a surface layer portion of a workpiece made of steel by heating said workpiece within a heat treatment furnace into which a heat treatment gas is introduced, said heat treatment gas containing ammonia gas, hydrogen gas and carbon dioxide gas, wherein said nitride layer is formed by heating said workpiece to a temperature range of more than or equal to 550° C. and less than or equal to 650° C. within said heat treatment furnace; and wherein an undecomposed ammonia fraction in an atmosphere within said heat treatment furnace is controlled such that a difference between a maximum value and a minimum value of the undecomposed ammonia fraction in said atmosphere obtained at a plurality of positions within said heat treatment furnace is less than or equal to 0.8% by increasing a flow rate of the carbon dioxide gas and a flow rate of the hydrogen gas, wherein a ratio of said flow rate of said carbon dioxide gas to a total flow rate of said heat treatment gas introduced into said heat treatment furnace is more than or equal to 5% and less than or equal to 20%, and wherein a ratio of said flow rate of said hydrogen gas to the total flow rate of said heat treatment gas introduced into said heat treatment furnace is more than or equal to 10% and less than or equal to 50%.

2. The gas nitrocarburizing method according to claim 1, wherein said workpiece is heated within said heat treatment furnace with an atmosphere within said heat treatment furnace being stirred by a stirring fan arranged within said heat treatment furnace.

* * * * *